US009533404B2

(12) United States Patent
Hu et al.

(10) Patent No.: US 9,533,404 B2
(45) Date of Patent: Jan. 3, 2017

(54) WRENCH WITH MAXIMUM OPERATIONAL TORQUE

(71) Applicant: Bobby Hu, Taichung (TW)

(72) Inventors: Bobby Hu, Taichung (TW); Hsien-Yi Chang, Nantou (TW)

(73) Assignee: Bobby Hu, Taichung (TW)

( * ) Notice: Subject to any disclaimer, the term of this patent is extended or adjusted under 35 U.S.C. 154(b) by 318 days.

(21) Appl. No.: 14/467,085

(22) Filed: Aug. 25, 2014

(65) Prior Publication Data

US 2015/0224634 A1 Aug. 13, 2015

(30) Foreign Application Priority Data

Feb. 11, 2014 (TW) ..... 103104480 A

(51) Int. Cl.

| | |
|---|---|
| ***B25B 23/142*** | (2006.01) |
| ***B25B 15/02*** | (2006.01) |
| ***B25B 23/16*** | (2006.01) |
| ***B25G 1/00*** | (2006.01) |
| ***B25G 1/08*** | (2006.01) |

(52) U.S. Cl.

CPC ..... *B25B 23/142* (2013.01); *B25B 15/02* (2013.01); *B25B 23/1427* (2013.01); *B25B 23/16* (2013.01); *B25G 1/005* (2013.01); *B25G 1/085* (2013.01)

(58) Field of Classification Search

CPC .. B25B 23/141; B25B 23/142; B25B 23/1427; B25B 15/02; B25G 1/005; B25G 1/085

See application file for complete search history.

(56) References Cited

U.S. PATENT DOCUMENTS

| | | | | | |
|---|---|---|---|---|---|
| 2,621,688 | A * | 12/1952 | Wales | B25B 13/54 | 125/40 |
| 2,768,547 | A * | 10/1956 | Noell | B25B 23/14 | 464/37 |
| 2,826,107 | A * | 3/1958 | Woods | B25B 13/465 | 192/46 |
| 4,238,978 | A * | 12/1980 | Leone | B25B 23/1427 | 464/35 |
| 4,893,529 | A * | 1/1990 | Lin | B25G 1/085 | 81/177.4 |
| 6,886,434 | B2 * | 5/2005 | Hu | B25B 23/1427 | 464/35 |
| 7,281,457 | B2 | 10/2007 | Hu | | |
| 8,051,748 | B2 * | 11/2011 | Lin | B25B 15/00 | 81/177.1 |
| 2004/0025319 | A1 * | 2/2004 | Murphy | B25G 1/005 | 29/525.01 |

* cited by examiner

*Primary Examiner* — David B Thomas

(74) *Attorney, Agent, or Firm* — Alan D. Kamrath; Kamrath IP Lawfirm, P.A.

(57) ABSTRACT

A wrench includes a body and a rod pivotably received in a first end of the body. A pressing device is mounted in the rod and presses against the body. A handle includes a shank and a connection end pivotably connected to the first end of the body. When the handle is in a coaxial position, the shank protrudes beyond an outer face of the first end. A longitudinal axis of the shank is coincident to the working axis. The shank can be rapidly rotated by fingers of a user. When the handle is in a storage position, the shank is received in a groove in the outer face. A palm of the user can grip and rotate the body without hindrance by the shank.

19 Claims, 9 Drawing Sheets

WRENCH WITH MAXIMUM OPERATIONAL TORQUE

BACKGROUND

The present invention relates to a wrench with maximum operational torque and, more particularly, to a wrench having maximum operational torque and allowing switching between two operational modes.

U.S. Pat. No. 7,281,457 discloses a wrench with adjustable maximum operational torque. In actual use, when a screw is gradually tightened but the rotational force has not reached the predetermined torque value of the wrench, the user would find that the rotational force applied by his or her fingers can not be increased and, thus, can not further tighten the screw. As a result, the screw can not be tightened to the desired preset extent.

To solve the above problem, the user generally tries to hold the wrench with the whole palm for the purposes of increasing the rotational force. However, the cylindrical protrusion on the top of the wrench hinders transmission of the rotational force to the wrench, leading to loss in the rotational force created by the wriest and the palm of the user and even causing pain or discomfort to the palm of the user. Thus, the user often rotates the wrench with both hands to achieve the desired preset tightening extent. However, operation of both hands is inconvenient to the user, reducing the purchase desire of the consumers and adversely affecting the reputation of this product.

Thus, a need exists for a novel wrench with maximum operational torque to mitigate and/or obviate the above disadvantages.

BRIEF SUMMARY

This need and other problems in the field of easy operations of wrenches with maximum operational torque are solved by a wrench including a body having a first end and a second end spaced from the first end along a working axis. The body is rotatable about the working axis. The first end of the body includes an outer face having a groove. A rod is pivotably received in the first end of the body and is rotatable about the working axis. The rod is adapted to drive an object to rotate. A pressing device is mounted in the rod and presses against the body. A handle includes a shank and a connection end. The connection end is pivotably connected to the first end of the body and is pivotable between a coaxial position and a storage position.

When the handle is in the coaxial position, the shank protrudes beyond the outer face of the first end of the body. A longitudinal axis of the shank is coincident to the working axis. The shank is adapted to be rapidly rotated by fingers of a user to rapidly rotate the object via the rod with a rotational force not exceeding a preset torque value.

On the other hand, when the handle is in the storage position, the shank is received in the groove of the body without protruding beyond the outer face of the first end of the body. A palm of the user is adapted to grip the body without hindrance by the shank and is adapted to rotate the body to drive the object via the rod with the rotational force not exceeding the preset torque value.

In an example, the second end of the body includes a first section spaced from the first end of the body in a radial direction perpendicular to the working axis. The groove extends from the outer face of the first end of the body towards but spaced from the second end of the body along the working axis. The groove extends in the radial direction and has an opening aligned with the first section of the second end of the body. The longitudinal axis of the shank extends perpendicularly to the working axis when the handle is in the storage position.

In an example, the connection end of the handle is pivotably connected to the first end of the body by an axle. The axle extends perpendicularly to the working axis and the longitudinal axis of the shank.

In an example, the body includes an axle hole extends through the first end of the body and extends perpendicularly to the working axis. The handle further includes a through-hole extending through the connection end of the handle and extending perpendicularly to the working axis. The axle extends through the axle hole of the body and the through-hole of the handle. The handle is pivotable relative to the body between the coaxial position and the storage position about an axis defined by the axle.

In an example, the groove of the body includes an end face having a retaining hole. The connection end of the handle includes an outer periphery having two positioning grooves respectively corresponding to the coaxial position and the storage position. A spring and a ball are received in the retaining hole. The ball is located between the spring and the connection end of the handle. The spring biases the ball into one of the two positioning grooves, reliably retaining the handle in one of the coaxial position and the storage position.

In an example, the shank of the handle includes a plurality of longitudinal grooves. The plurality of longitudinal grooves is adapted to increase a frictional force provided by the shank of the handle to allow stable rotation of the wrench while the fingers of the user are rapidly rotating the handle.

In an example, the rod includes a driving end having a coupling groove. The coupling groove has non-circular cross sections. The handle has an outer diameter smaller than an outer diameter of the driving end of the rod.

In an example, the second end of the body includes a first section spaced from the first end of the body in a radial direction perpendicular to the working axis. The second end of the body includes an operating portion on an outer periphery thereof The operating portion is adapted to be rotated by the user. The second end of the body includes a bottom face opposite to the outer face of the first end of the body. The bottom face of the body includes a first receiving portion defining an engagement groove in the first section of the second end of the body. A first positioning member is mounted in the engagement groove. The rod includes a first arm extending in the radial direction. The first arm includes a receptacle. The pressing device is received in the receptacle of the first arm. The pressing device presses against the first positioning member.

In an example, the first positioning member includes a pressing section and an inclined face adjoining the pressing section. The pressing device includes an elastic element and a first pressing member. The elastic element biases the first pressing member to press against the pressing section of the first positioning member. When the rotational force applied to the body is smaller than an engaging force between the first pressing member and the pressing section of the first positioning member. The rod rotates together with the body and drives the object to rotate. When the rotational force applied to the body is larger than the engaging force between the first pressing member and the pressing section of the first positioning member, the body slides relative to the rod without driving the object.

In an example, the first receiving portion includes a buffering groove adjacent to the inclined face of the first positioning member.

In an example, the first positioning member and the body are integrally formed as a single and inseparable component of the same material.

In an example, the first end of the body includes a positioning hole extending along the working axis and in communication with the first receiving portion. A ball is received in the positioning hole. The rod includes a top end opposite to the driving end. The top end of the rod is received in the positioning hole and rotatably contacts the ball to allow stable pivotal movement of the body.

In an example, a lid is mounted to and covering the bottom face of the body to seal the first receiving portion. The lid includes a through-hole through which the rod extends.

In an example, the second end of the body further includes a second section. The first and second sections are diametrically opposed to each other in the radial direction and located on opposite sides of the working axis. The bottom face of the body further includes a second receiving portion defining an engagement groove in the second section of the second end of the body. A second positioning member is mounted in the engagement groove of the second receiving portion. The rod further includes a second arm extending in the radial direction and opposite to the first arm. The second arm includes a receptacle aligned with and in communication with the receptacle of the first arm. The elastic element is received in the receptacles of the first and second arms. The pressing device presses against the first and second positioning members.

In an example, the second positioning member includes a pressing section and an inclined face adjoining the pressing section of the second positioning member. The pressing device further includes a second pressing member. The elastic element is located between the first and second pressing members. The elastic element biases the second pressing member to press against the pressing section of the second positioning member. When the rotational force applied to the body is smaller than an engaging force between the first and second pressing members and the pressing sections of the first and second positioning members, the rod rotates together with the body. When the rotational force applied to the body is larger than the engaging force between the first and second pressing members and the pressing sections of the first and second positioning members, the body slides relative to the rod without driving the object.

In an example, the second receiving portion includes a buffering groove adjacent to the inclined face of the second positioning member.

In an example, the wrench is substantially cruciform in cross section when the handle is in the coaxial position, allowing the fingers of the user to rapidly rotate the shank of the handle to save time for rotating the object. The wrench is substantially T-shaped in cross section when the handle is in the storage position. The palm of the user is adapted to completely hold the body and with the palm of the user completely abutting the outer face of the first end of the body without hindrance by the shank, allowing easy application of the rotational force. The rotational force applied from a wrist and the palm of the user is adapted to be completely transmitted to the wrench to rotate the object with a force-saving effect while driving the object. The rotational force does not exceed the preset torque value. Thus, the wrench provides two different operational modes for selection by the user.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
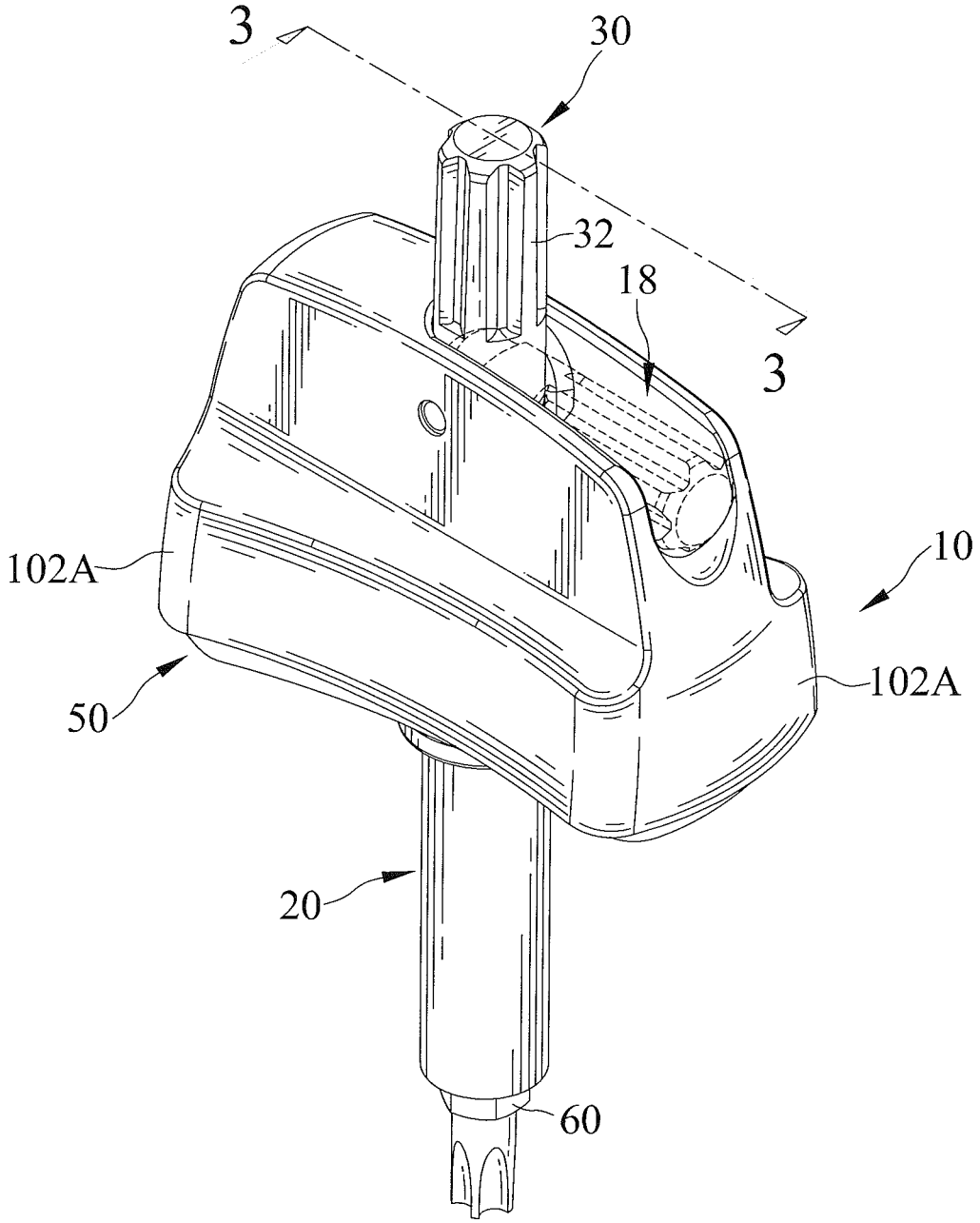
FIG. 1 is a perspective view of a wrench with maximum operational torque according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "outer", "top", "bottom", "side", "end", "portion", "section", "longitudinal", "radial", "height", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-9 show a wrench with maximum operational torque according to the present invention. The wrench includes a body 10, a rod 20, a handle 30 mounted to a top end of the body 10, and a pressing device 40 mounted in the rod 20 and pressing against the body 20. The handle 30 can move between a coaxial position and a storage position. When the handle 30 is in the coaxial position, a shank 32 can be rapidly rotated by fingers of a user to rapidly rotate an object 90 (such as a fastener, see FIG. 5) with a rotational force not exceeding a preset torque value (i.e., the maximum operational torque). When the handle 30 is in the storage position, a palm of the user can grip the body 10 without hindrance by the shank 32 and can rotate the body 10 to drive the object 90 with a rotational force not exceeding the preset torque value.

Figure 2:
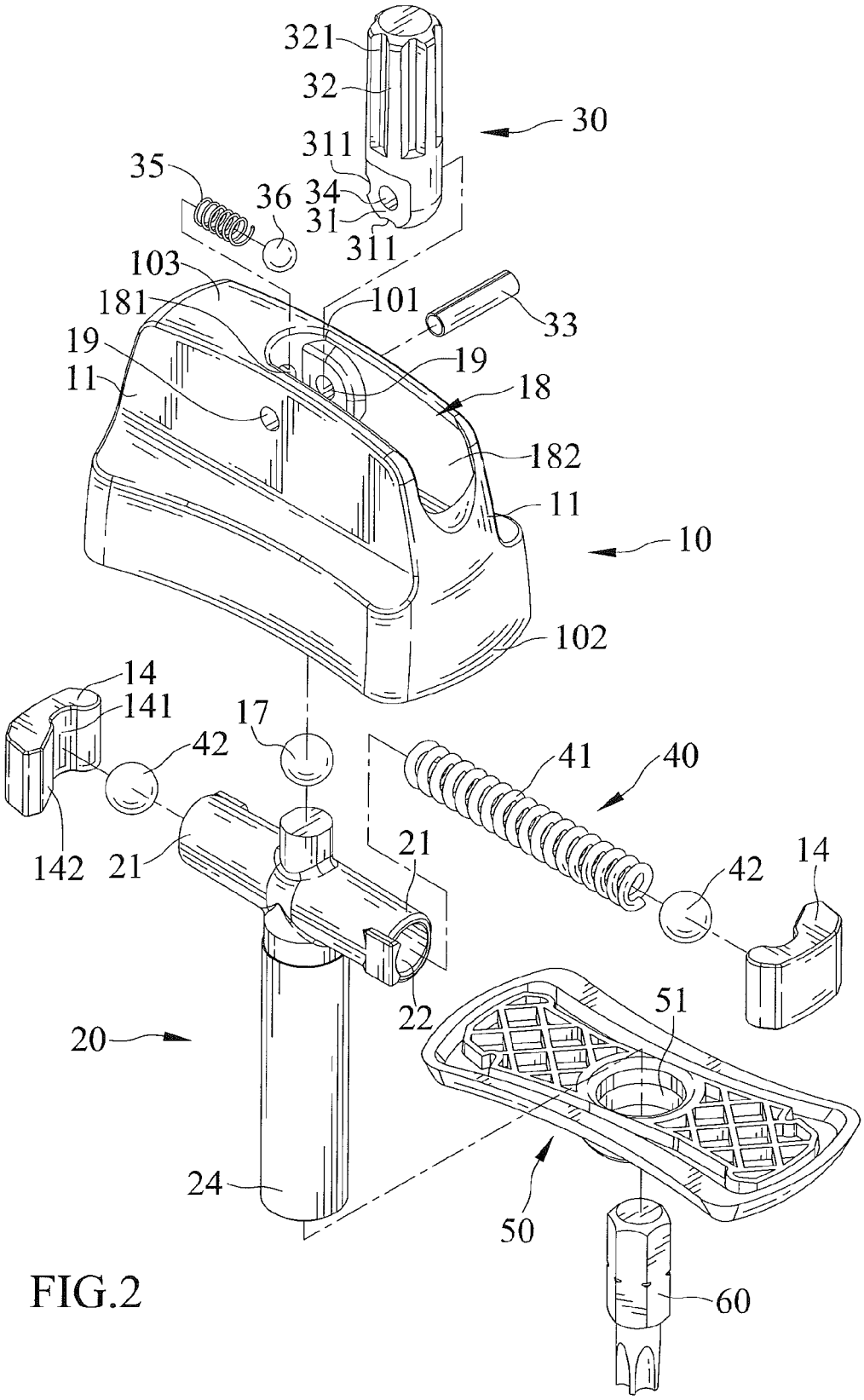
FIG. 2 is an exploded, perspective view of the wrench of FIG. 1.
Figure 3:
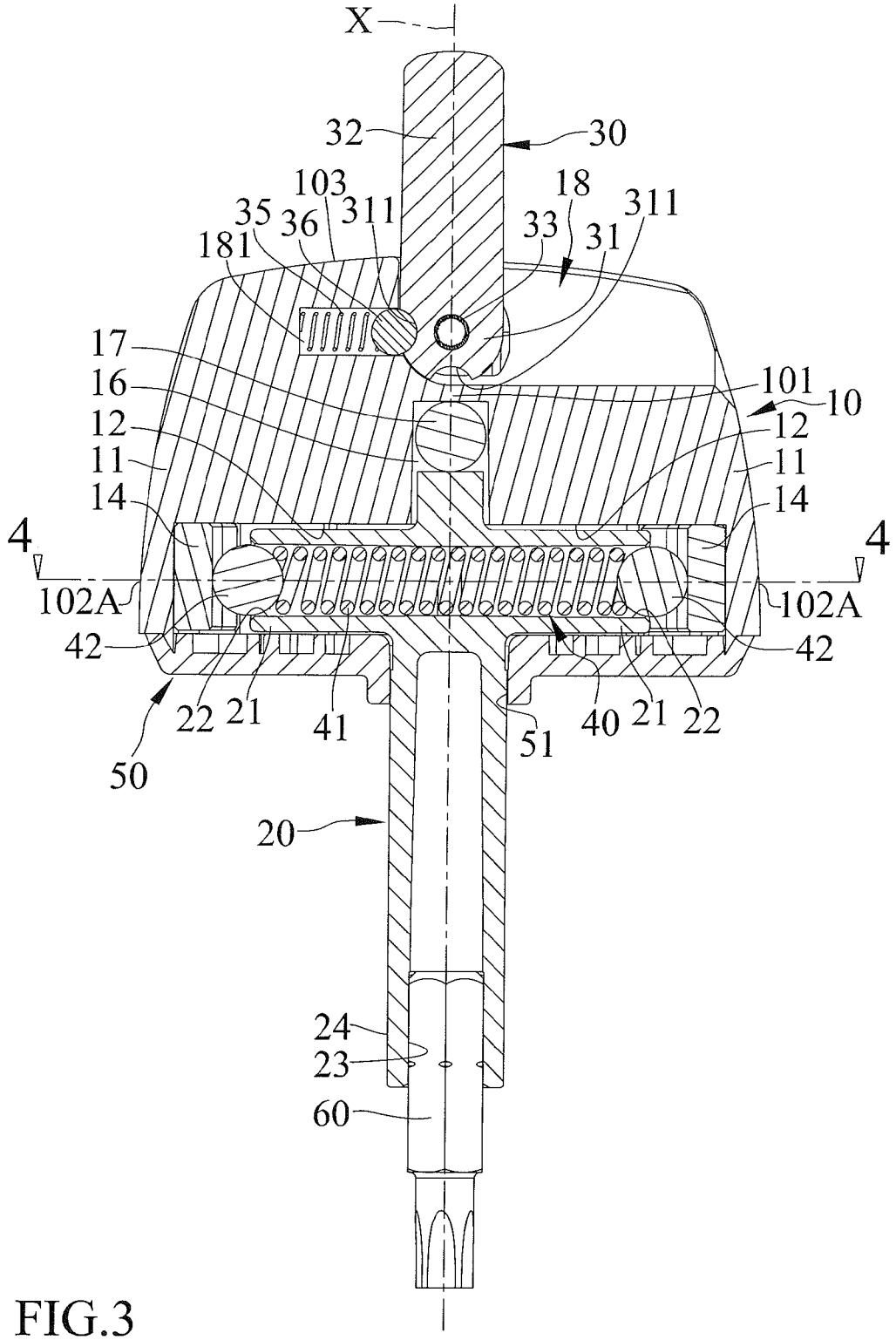
FIG. 3 is a cross sectional view taken along section plane 3-3 of FIG. 1.
Figure 4:
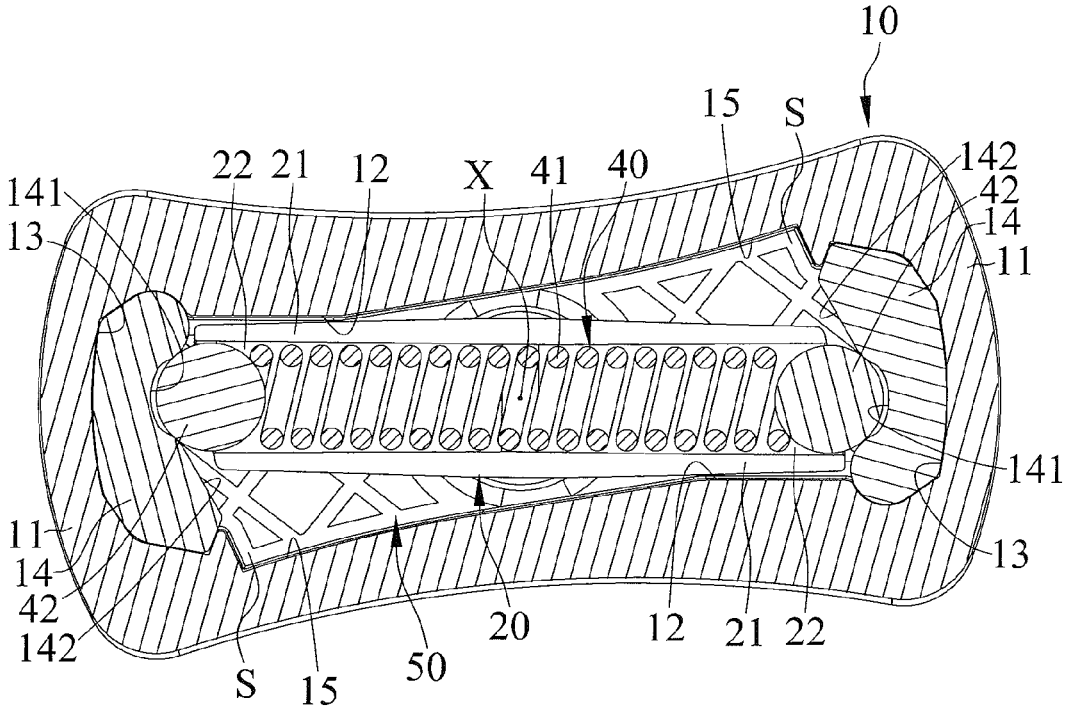
FIG. 4 is a cross sectional view taken along section line 4-4 of FIG. 3.

With reference to FIGS. 2-4, the body 10 includes a first end 101 and a second end 102 spaced from the first end 101 along a working axis X. The body 10 can rotate about the working axis X. The first end 101 of the body 10 includes an outer face 103 having a groove 18.

In the form shown, the second end 102 of the body 10 includes a first section 102A spaced from the first end 101 of the body 10 in a radial direction perpendicular to the working axis X. The second end 102 of the body 10 further includes a second section 102A. The first and second sections 102A are diametrically opposed to each other in the radial direction and are located on opposite sides of the working axis X.

The second end 102 of the body 10 includes an operating portion 11 on an outer periphery thereof. The operating portion 11 is adapted to be rotated by the user. The second end 102 of the body 10 includes a bottom face opposite to the outer face 103 of the first end 101 of the body 10. The bottom face of the body 10 includes a first receiving portion 12 defining an engagement groove 13 in the first section 102A of the second end 102 of the body 10. A first positioning member 14 is mounted in the engagement groove 13. The bottom face of the body 10 further includes a second receiving portion 12 defining an engagement groove 13 in the second section 102A of the second end 102 of the body 10. A second positioning member 14 is mounted in the engagement groove 13 of the second receiving portion 12. It can be appreciated that the first and second positioning members 14 and the body 10 can be integrally formed as a single and inseparable component of the same material.

Each of the first and second positioning members 14 includes a pressing section 141 and an inclined face 142 adjoining the pressing section 141. Furthermore, each of the first and second receiving portions 12 includes a buffering groove 15 adjacent to the inclined face 142 of a corresponding one of the first and second positioning members 14. The first end 101 of the body 10 includes a positioning hole 16 extending along the working axis X and in communication with the first and second receiving portions 12. A ball 17 is received in the positioning hole 16.

The groove 18 extends from the outer face 103 of the first end 101 of the body 10 towards but spaced from the second end 102 of the body 10 along the working axis X. The groove 18 extends in the radial direction and has an opening 182 aligned with the first section 102A of the second end 102 of the body 10.

The rod 20 is pivotably received in the first end 101 of the body 10 and is rotatable about the working axis X. The rod 20 includes a driving end 24 adapted for driving the object 90 to rotate. The driving end 24 of the rod 20 includes a coupling groove 23 having non-circular (hexagonal in the form shown) cross sections. Furthermore, the rod 20 includes a top end opposite to the driving end 24. The top end of the rod 20 is received in the positioning hole 16 and rotatably contacts the ball 17 to allow stable pivotal movement of the body 10. The rod 20 includes a first arm 21 extending in the radial direction and having a receptacle 22. The rod 20 further includes a second arm 21 extending in the radial direction and opposite to the first arm 21. The second arm 21 includes a receptacle 22 aligned with and in communication with the receptacle 22 of the first arm 21.

The handle 30 includes a connection end 31 pivotably connected to the first end 101 of the body 10. The handle 30 is pivotable between the coaxial position and the storage position.

When the handle 30 is in the coaxial position, the shank 32 protrudes beyond the outer face 103 of the first end 101 of the body 10. A longitudinal axis of the shank 32 is coincident to the working axis X. The shank 32 is adapted to be rapidly rotated by the fingers of the user to rapidly rotate the object 90 via the rod 20 with a rotational force not exceeding the preset torque value.

On the other hand, when the handle 30 is in the storage position, the shank 32 is received in the groove 18 of the body 10 without protruding beyond the outer face 103 of the first end 101 of the body 10. The palm of the user can grip the body 10 without hindrance by the shank 32 and can rotate the body 10 to drive the object 90 via the rod 20 with the rotational force not exceeding the preset torque value while providing a force-saving effect.

In the form shown, the connection end 31 of the handle 30 is pivotably connected to the first end 101 of the body 10 by an axle 33 extending perpendicularly to the working axis X and the longitudinal axis of the shank 32. The longitudinal axis of the shank 32 extends perpendicularly to the working axis X when the handle 30 is in the storage position.

The body 10 further includes an axle hole 19 extending through the first end 101 of the body 10 and extending perpendicularly to the working axis X. The handle 30 further includes a through-hole 34 extending through the connection end 31 of the handle 30 and extending perpendicularly to the working axis X. The axle 33 extends through the axle hole 19 of the body 10 and the through-hole 34 of the handle 30. Thus, the handle 30 is pivotable relative to the body 10 between the coaxial position and the storage position about an axis defined by the axle 33.

The groove 18 of the body 10 includes an end face opposite to the opening 182 and having a retaining hole 181. The connection end 31 of the handle 30 includes an outer periphery having two positioning grooves 311 respectively corresponding to the coaxial position and the storage position. A spring 35 and a ball 36 are received in the retaining hole 181. The ball 36 is located between the spring 35 and the connection end 31 of the handle 30. The spring 35 biases the ball 36 into one of the positioning grooves 311, reliably retaining the handle 30 in one of the coaxial position and the storage position.

The shank 32 of the handle 30 includes a plurality of longitudinal grooves 321. The longitudinal grooves 321 are adapted to increase a frictional force provided by the shank 32 of the handle 30 to allow stable rotation of the wrench while the fingers of the user are rapidly rotating the handle 30. The handle 30 has an outer diameter smaller than an outer diameter of the driving end 24 of the rod 20, allowing rapid rotation by the fingers of the user. Thus, the object 90 can be rapidly rotated to save the time of rotation.

The pressing device 40 is mounted in the receptacles 22 of the first and second arms 21 of the rod 20 and presses against the body 10. Specifically, the pressing device 40 includes first and second pressing members 42 and an elastic element 41 between the first and second pressing members 42. Each of the first and second pressing members 42 is in the form of a ball in the form shown. The elastic element 41 biases the first and second pressing members 42 to respectively press against the pressing sections 141 of the first and second positioning members 14.

When the rotational force applied to the body 10 is smaller than an engaging force (the preset torque value)

between the first and second pressing members 42 and the pressing sections 141 of the first and second positioning members 14, the rod 20 rotates together with the body 10.

On the other hand, when the rotational force applied to the body 10 is larger than the engaging force between the first and second pressing members 42 and the pressing sections 141 of the first and second positioning members 14, the body 10 slides relative to the rod 20 without driving the object 90.

A lid 50 is mounted to and covers the bottom face of the body 10 to seal the first and second receiving portions 12. The lid 50 includes a through-hole 51 through which the rod 20 extends.

A bit 60 can be coupled in the coupling groove 23 of the rod 20 and can be used to drive the object 90. An end of the bit 60 is inserted into the coupling groove 23 of the rod 20. In the form shown, the bit 60 includes hexagonal cross sections to match with the coupling groove 23.

Figure 5:
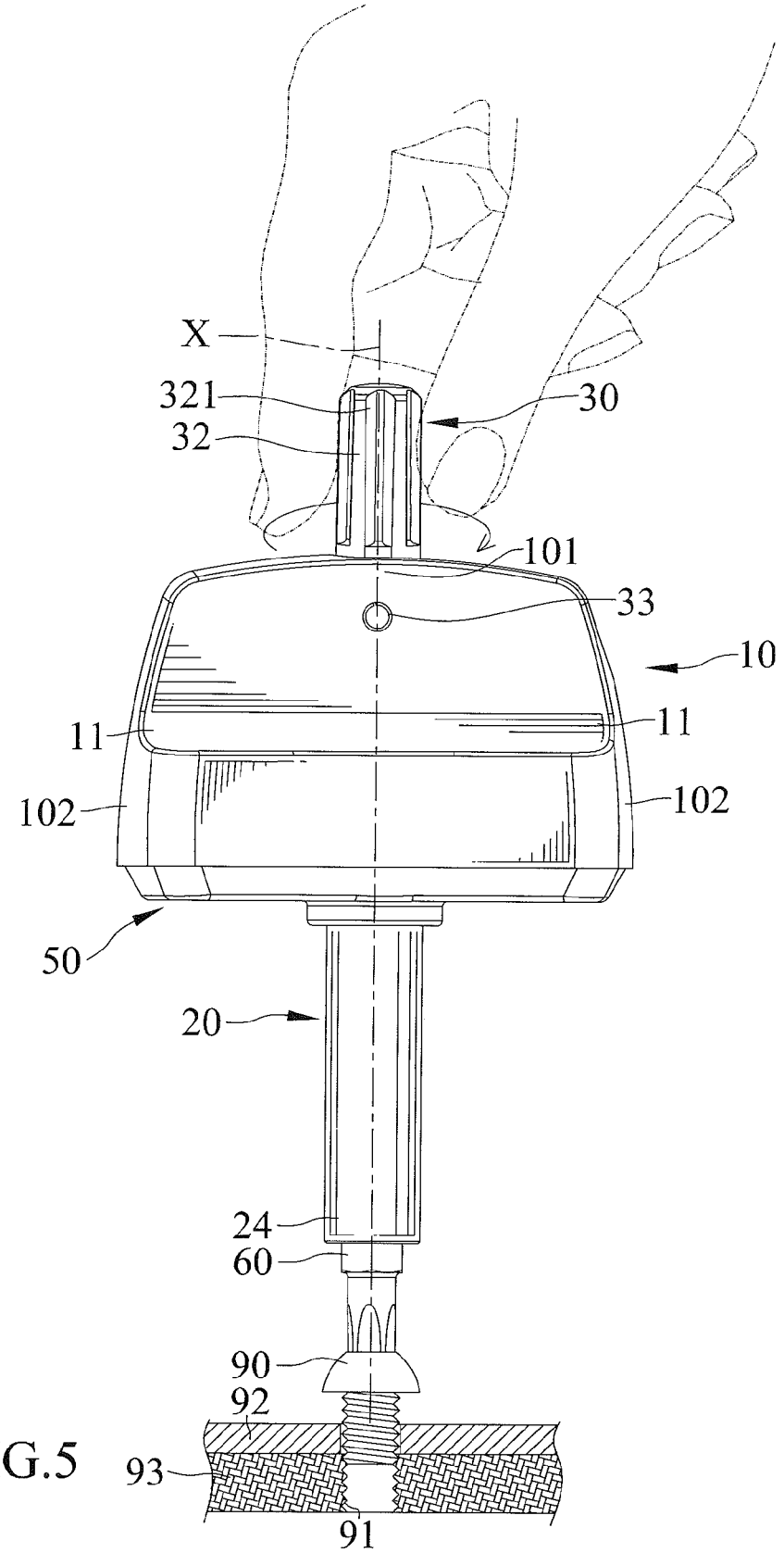
FIG. 5 is a side view illustrating an operational mode of the wrench of FIG. 1.

With reference to FIGS. 4 and 5, in use, the rotational force applied by the user is transmitted to the object 90. If the reactive force from the object 90 is smaller than the preset torque value, the first and second pressing members 42 firmly press against the pressing sections 141 of the first and second positioning members 14. Thus, the body 10 drives the object 90 to rotate via the rod 20.

When the handle 30 is in the coaxial position, the shank 32 protrudes beyond the outer face 103 of the first end 101 of the body 10. The longitudinal axis of the shank 32 is coincident to the working axis X. The shank 32 can be rapidly rotated by the fingers of the user to rapidly rotate the object 90 via the rod 20 with a rotational force not exceeding the preset torque value while providing a force-saving effect. Thus, the object 90 can be rapidly driven into a screw hole 91 with the shortest time until the object 90 is about to tighten articles 92 and 93 to be tightened.

Figure 6:
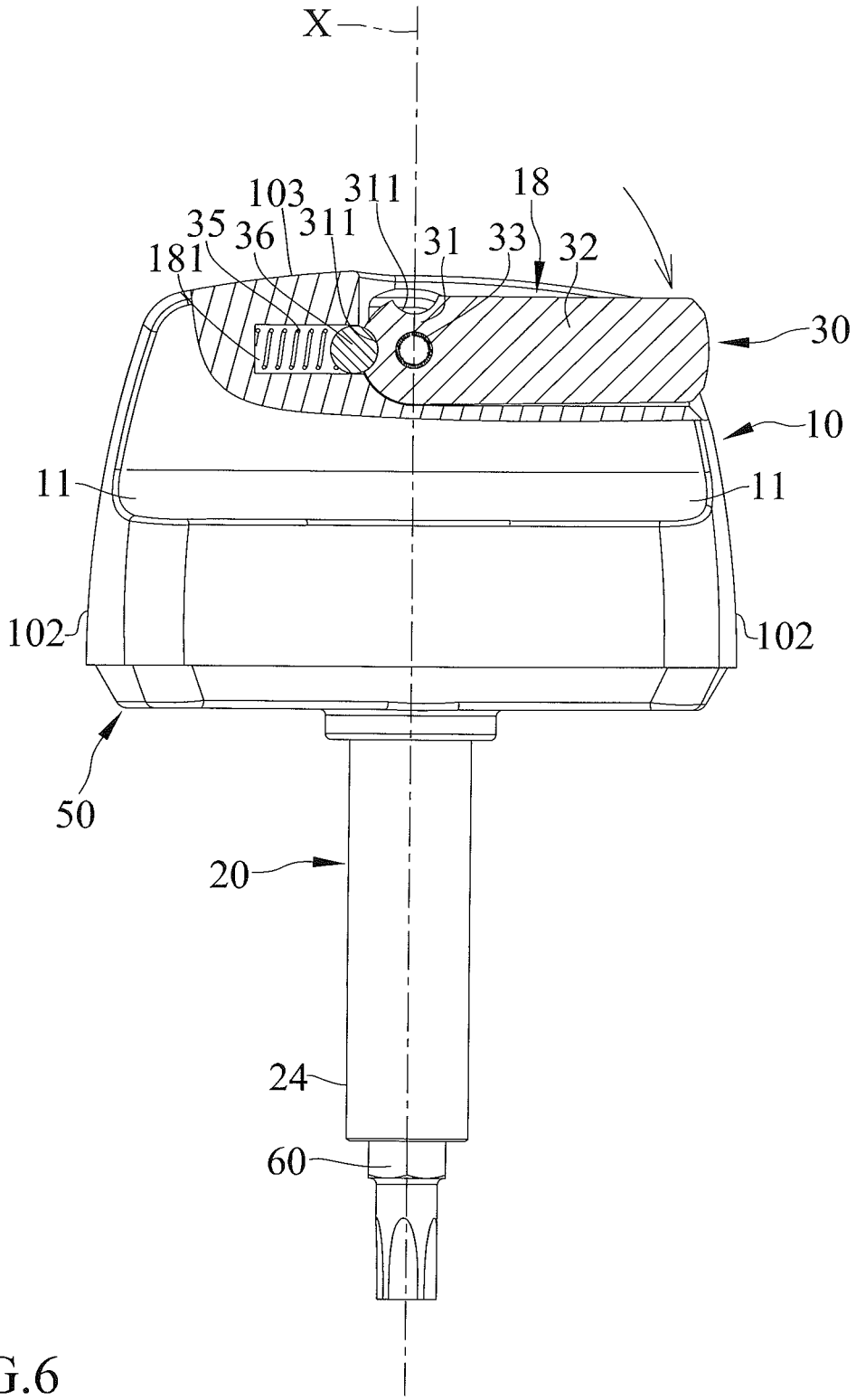
FIG. 6 is a partially cross-sectioned side view of the wrench of FIG. 1, with a handle pivoted to a storage position.
Figure 7:
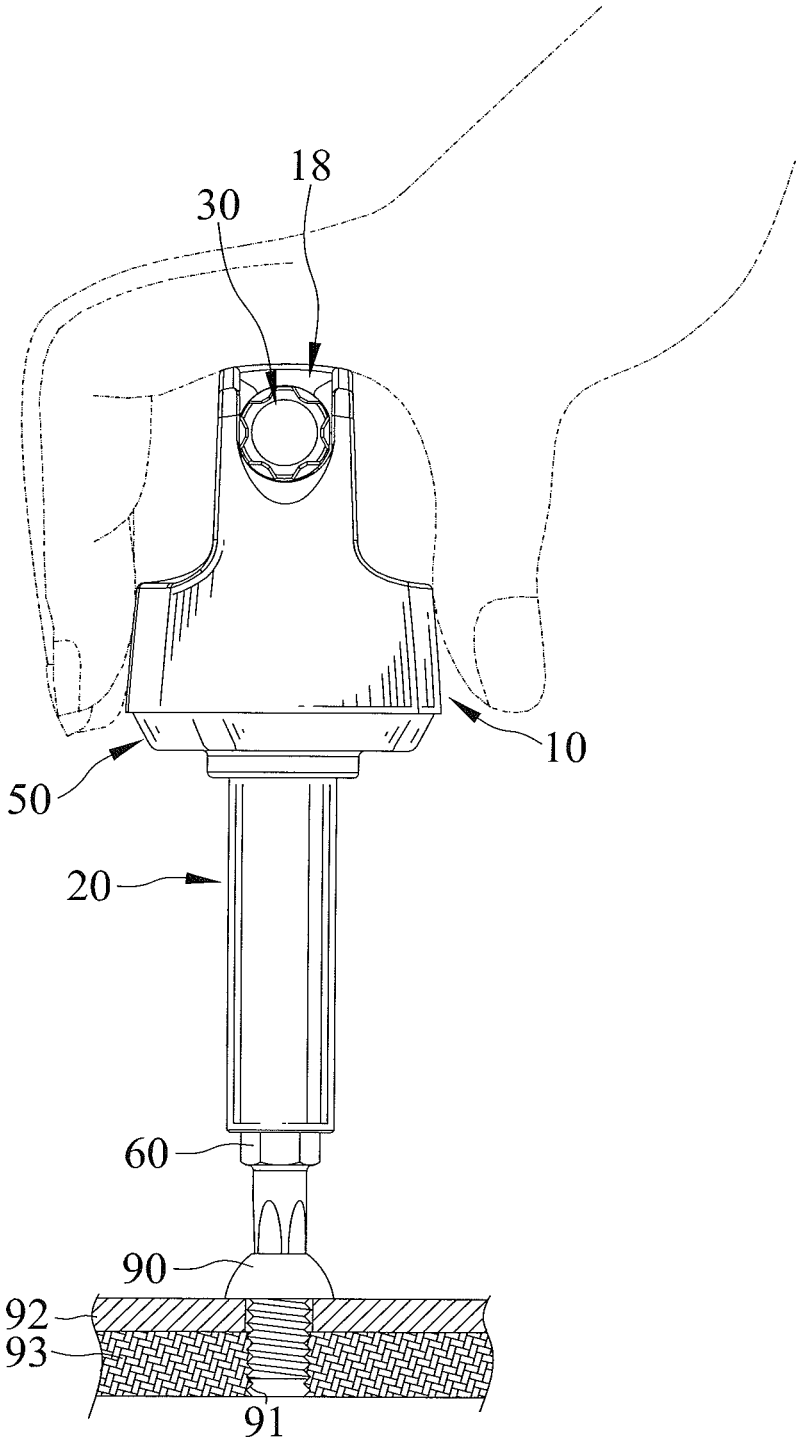
FIG. 7 is a side view illustrating another operational mode of the wrench of FIG. 1, with the handle in the storage position.

With reference to FIGS. 6-9, if a larger force is required to drive the object 90 for tightening the articles 92 and 93 to be tightened, the handle 30 is moved from the coaxial position to the storage position. As indicated in FIG. 6, the shank 32 is received in the groove 18 of the body 10 without protruding beyond the outer face 103 of the first end 101 of the body 10. The palm of the user can completely hold the body 10 with the palm of the user completely abutting the outer face 103 of the first end 101 of the body 10 without hindrance by the shank 32, allowing easy application of the rotational force. The rotational force applied from the wrist and the palm of the user can be completely transmitted to the wrench to rotate the object 90 with a force-saving effect while driving the object 90. Note that the rotational force does not exceed the preset torque value.

Figure 8:
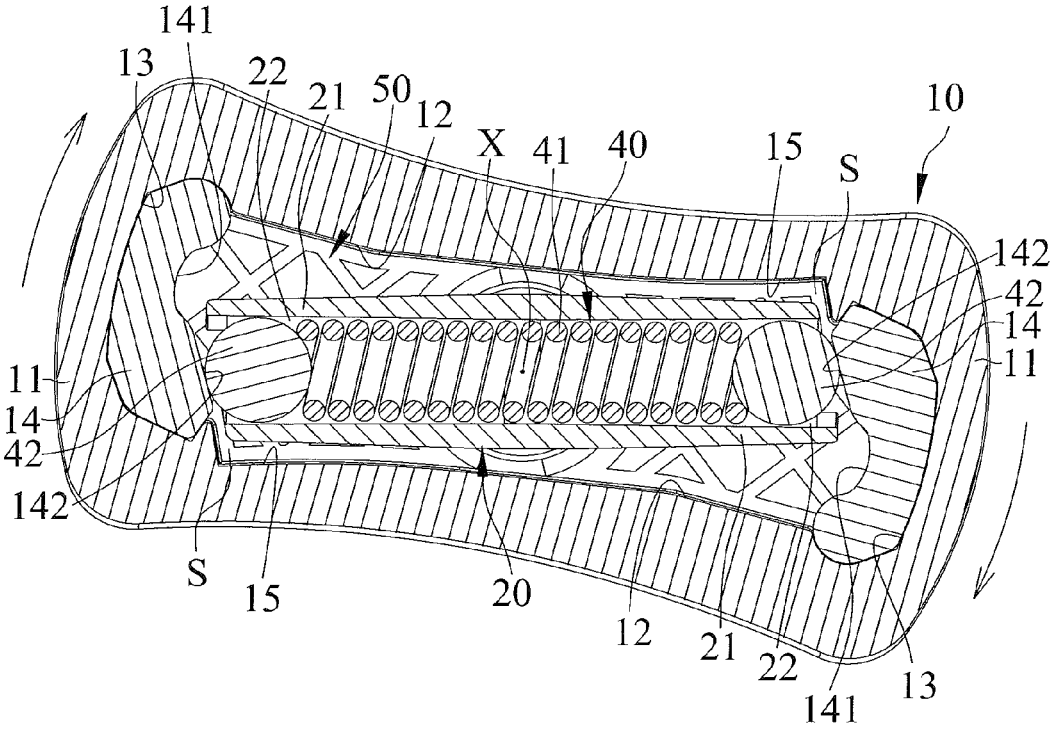
FIG. 8 is a view similar to FIG. 4, with two pressing members disengaged from two pressing sections of two positioning members and moved to two inclined faces of the positioning members to indicate the rotational force applied to an object has reached a preset torque value.
Figure 9:
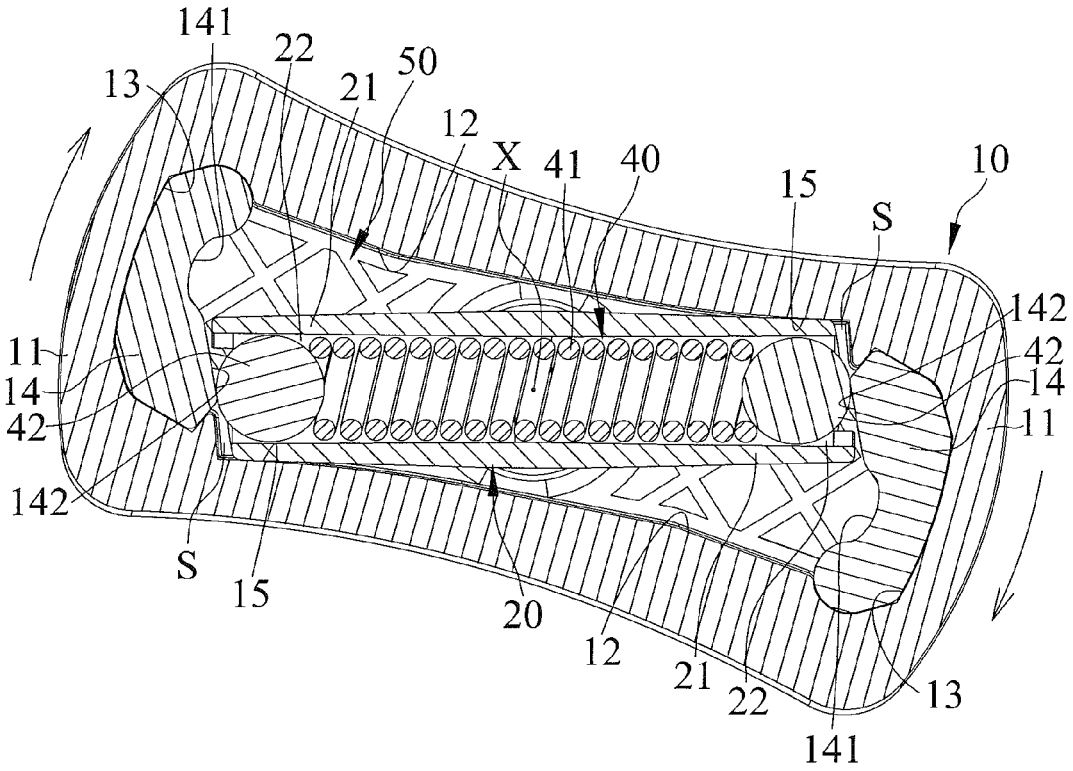
FIG. 9 is a view similar to FIG. 8, illustrating a buffering effect of the wrench.

With reference to FIGS. 8 and 9, if the reactive force from the object 90 is larger than the preset torque value, the elastic element 41 is compressed to absorb the excessive force, and the first and second pressing members 42 disengage from the pressing sections 141 of the first and second positioning members 14 and slide to the inclined faces 142. At the same time, the first and second pressing members 42 slightly move into the receptacles 22 of the first and second arms 21 of the rod 20. Thus, the rod 20 pivots relative to the body 10. The user can be aware of the sliding movement of the first and second pressing members 42 and realize that the torque applied to the object 90 has reached the preset torque value. Thus, the user can stop driving the object 90.

When the first and second pressing members 42 move out of the pressing sections 141 of the first and second positioning members 14 and slide to the inclined faces 142, the buffering grooves 15 between the rod 20 and the first and second receiving portions 12 provide buffering spaces S to avoid the rod 20 from being driven by the inertia of the body 10, effectively avoiding damage to the object 90 due to excessive torque. A safety design is, thus, provided. When the user stops applying force to the body 10, the first and second pressing members 42 move through the inclined faces 142 back to the pressing sections 141, causing reverse pivotal movement of the rod 20 relative to the body 10. Thus, the rod 20 returns to the position shown in FIG. 4, providing a convenient operation.

By such an arrangement, when the handle 30 is in the storage position, the handle 30 is received in the groove 18 of the body 10 without protruding beyond the outer face 103 of the first end 101 of the body 10. The palm of the user can completely hold the body 10 with the palm of the user completely abutting the outer face 103 of the first end 101 of the body 10 without hindrance by the shank 32, allowing easy application of the rotational force. The rotational force applied from the wrist and the palm of the user can be completely transmitted to the wrench to rotate the object 90 with a force-saving effect while driving the object 90.

The wrench is substantially cruciform in cross section when the handle 30 is in the coaxial position, allowing the fingers of the user to rapidly rotate the shank 32 of the handle 30 to save time for rotating the object 90. On the other hand, the wrench is substantially T-shaped in cross section when the handle 30 is in the storage position. The palm of the user can completely hold the body 10 with the palm of the user completely abutting the outer face 103 of the first end 101 of the body 10 without hindrance by the shank 32, allowing easy application of the rotational force. The rotational force applied from the wrist and the palm of the user can be completely transmitted to the wrench to rotate the object 90 with a force-saving effect while driving the object 90. Note that the rotational force does not exceed the preset torque value. The overall height of the wrench is reduced to allow easy storage and carriage, stimulating the purchase desire of the user. Furthermore, the wrench according to the present invention provides two different operational modes for selection by the user, which is a design of high precision and high quality.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A wrench comprising:

a body including a first end and a second end spaced from the first end along a working axis, with the body rotatable about the working axis, and with the first end of the body including an outer face having a groove;

a rod pivotably received in the first end of the body and rotatable about the working axis, with rod adapted to drive an object to rotate;

a pressing device mounted in the rod and pressing against the body; and a handle including a shank and a connection end, with the connection end pivotably connected to the first end of the body, and with the handle pivotable between a coaxial position and a storage position, wherein when the handle is in the coaxial position, the shank protrudes beyond the outer face of the first end of the body, with a longitudinal axis of the shank coincident to the working axis, and wherein when the handle is in the storage position, the shank is received in the groove of the body without protruding beyond the outer face of the first end of the body.

2. The wrench as claimed in claim 1, with the second end of the body including a first section spaced from the first end of the body in a radial direction perpendicular to the working axis, with the groove extending from the outer face of the first end of the body towards but spaced from the second end of the body along the working axis, with the groove extending in the radial direction and having an opening aligned with the first section of the second end of the body, and with the longitudinal axis of the shank extending perpendicularly to the working axis when the handle is in the storage position.

3. The wrench as claimed in claim 1, with the connection end of the handle pivotably connected to the first end of the body by an axle, and with the axle extending perpendicularly to the working axis and the longitudinal axis of the shank.

4. The wrench as claimed in claim 3, with the body including an axle hole extending through the first end of the body and extending perpendicularly to the working axis, with the handle further including a through-hole extending through the connection end of the handle and extending perpendicularly to the working axis, with the axle extending through the axle hole of the body and the through-hole of the handle, and with the handle pivotable relative to the body between the coaxial position and the storage position about an axis defined by the axle.

5. The wrench as claimed in claim 4, with the groove of the body including an end face having a retaining hole, with the connection end of the handle including an outer periphery having two positioning grooves respectively corresponding to the coaxial position and the storage position, with a spring and a ball received in the retaining hole, with the ball located between the spring and the connection end of the handle, and with the spring biasing the ball into one of the two positioning grooves, reliably retaining the handle in one of the coaxial position and the storage position.

6. The wrench as claimed in claim 5, with the shank of the handle including a plurality of longitudinal grooves, and with the plurality of longitudinal grooves adapted to increase a frictional force provided by the shank of the handle to allow stable rotation of the wrench while the fingers of the user are rapidly rotating the handle.

7. The wrench as claimed in claim 5, with the rod including a driving end having a coupling groove, with the coupling groove having non-circular cross sections, and with the handle having an outer diameter smaller than an outer diameter of the driving end of the rod.

8. The wrench as claimed in claim 1, with the second end of the body including a first section spaced from the first end of the body in a radial direction perpendicular to the working axis, with the second end of the body including an operating portion on an outer periphery thereof, with the operating portion adapted to be rotated by the user, with the second end of the body including a bottom face opposite to the outer face of the first end of the body, with the bottom face of the body including a first receiving portion defining an engagement groove in the first section of the second end of the body, with a first positioning member mounted in the engagement groove, with the rod including a first arm extending in the radial direction, with the first arm including a receptacle, with the pressing device received in the receptacle of the first arm, and with the pressing device pressing against the first positioning member.

9. The wrench as claimed in claim 8, with the first positioning member including a pressing section and an inclined face adjoining the pressing section, with the pressing device including an elastic element and a first pressing member, with the elastic element biasing the first pressing member to press against the pressing section of the first positioning member, wherein when the rotational force applied to the body is smaller than an engaging force between the first pressing member and the pressing section of the first positioning member, the rod rotates together with the body and drives the object to rotate, and wherein when the rotational force applied to the body is larger than the engaging force between the first pressing member and the pressing section of the first positioning member, the body slides relative to the rod without driving the object.

10. The wrench as claimed in claim 9, with the first receiving portion including a buffering groove adjacent to the inclined face of the first positioning member.

11. The wrench as claimed in claim 10, with the first positioning member and the body integrally formed as a single and inseparable component of a same material.

12. The wrench as claimed in claim 10, with the first end of the body including a positioning hole extending along the working axis and in communication with the first receiving portion, with a ball received in the positioning hole, with the rod including a top end opposite to the driving end, with the top end of the rod received in the positioning hole and rotatably contacting the ball to allow stable pivotal movement of the body.

13. The wrench as claimed in claim 12, further comprising: a lid mounted to and covering the bottom face of the body to seal the first receiving portion, with the lid including a through-hole, and with the rod extending through the through-hole.

14. The wrench as claimed in claim 9, with the second end of the body further including a second section, with the first and second sections diametrically opposed to each other in the radial direction and located on opposite sides of the working axis, with the bottom face of the body further including a second receiving portion defining an engagement groove in the second section of the second end of the body, with a second positioning member mounted in the engagement groove of the second receiving portion, with the rod further including a second arm extending in the radial direction and opposite to the first arm, with the second arm including a receptacle aligned with and in communication with the receptacle of the first arm, with the elastic element received in the receptacles of the first and second arms, and with the pressing device pressing against the first and second positioning members.

15. The wrench as claimed in claim 14, with the second positioning member including a pressing section and an inclined face adjoining the pressing section of the second positioning member, with the pressing device further including a second pressing member, with the elastic element located between the first and second pressing members, with the elastic element biasing the second pressing member to press against the pressing section of the second positioning member, wherein when the rotational force applied to the body is smaller than an engaging force between the first and second pressing members and the pressing sections of the first and second positioning members, the rod rotates together with the body, and wherein when the rotational force applied to the body is larger than the engaging force between the first and second pressing members and the pressing sections of the first and second positioning members, the body slides relative to the rod without driving the object.

16. The wrench as claimed in claim 15, with the second receiving portion including a buffering groove adjacent to the inclined face of the second positioning member.

17. The wrench as claimed in claim 16, with the wrench being substantially cruciform in cross section when the handle is in the coaxial position, allowing the fingers of the user to rapidly rotate the shank of the handle to save time for rotating the object, with the wrench being substantially T-shaped in cross section when the handle is in the storage position, with the palm of the user adapted to completely hold the body and with the palm of the user completely abutting the outer face of the first end of the body without hindrance by the shank, allowing easy application of the rotational force, with the rotational force applied from a wrist and the palm of the user adapted to be completely transmitted to the wrench to rotate the object with a force-saving effect while driving the object, with the rotational force not exceeding the preset torque value, and with the wrench providing two different operational modes for selection by the user.

18. The wrench as claimed in claim 1, wherein when the handle is in the coaxial position, the shank is adapted to be rapidly rotated by fingers of a user to rapidly rotate the object via the rod with a rotational force not exceeding a preset torque value.

19. The wrench as claimed in claim 1, wherein when the handle is in the storage position, a palm of the user is adapted to grip the body without hindrance by the shank and adapted to rotate the body to drive the object via the rod with the rotational force not exceeding the preset torque value.

* * * * *